US006546964B1

(12) United States Patent
Westerkamp

(10) Patent No.: US 6,546,964 B1
(45) Date of Patent: Apr. 15, 2003

(54) MULTI-LAYER PAPER MACHINE WIRE FOR DEWATERING AND SHEETFORMING PURPOSES

(75) Inventor: Arved H. Westerkamp, Heidenheim (DE)

(73) Assignee: Voith Fabrics Heidenheim GmbH & Co. KG (DE)

( * ) Notice: Subject to any disclaimer, the term of this patent is extended or adjusted under 35 U.S.C. 154(b) by 0 days.

(21) Appl. No.: 09/470,364

(22) Filed: Dec. 22, 1999

(30) Foreign Application Priority Data

Dec. 22, 1998 (DE) ..... 198 59 581

(51) Int. Cl.[7] ..... D03D 13/00; D21F 7/10

(52) U.S. Cl. ..... 139/383 A; 139/383 R; 139/408

(58) Field of Search ..... 139/383 A, 383 R, 139/408

(56) References Cited

U.S. PATENT DOCUMENTS 4,821,780 A * 4/1989 Tate ..... 139/383 A
5,056,565 A * 10/1991 Kufferath ..... 139/383 A
5,219,004 A * 6/1993 Chiu ..... 139/383 A

* cited by examiner

*Primary Examiner*—John J. Calvert
*Assistant Examiner*—Robert H. Muromoto
(74) *Attorney, Agent, or Firm*—Gifford, Krass, Groh, Sprinkle, Anderson & Citkowski, P.C.

(57) ABSTRACT

A paper machine wire for dewatering and sheet forming purposes is structured such that the tendency of causing wire marks is decreased and simultaneously a greater wearing capacity is gained by exchangeably working threads. The multi-layer paper machine wire includes an upper fabric layer and a lower fabric layer with each layer being connected to one another by binding thread. The lower fabric includes a weft thread that extends from a running side of the lower fabric to a center position and overlaps a warp thread. The weft thread protects the warp thread against wear and forms a cushion against wire marking.

11 Claims, 1 Drawing Sheet

MULTI-LAYER PAPER MACHINE WIRE FOR DEWATERING AND SHEETFORMING PURPOSES

BACKGROUND OF THE INVENTION

Figure 1:
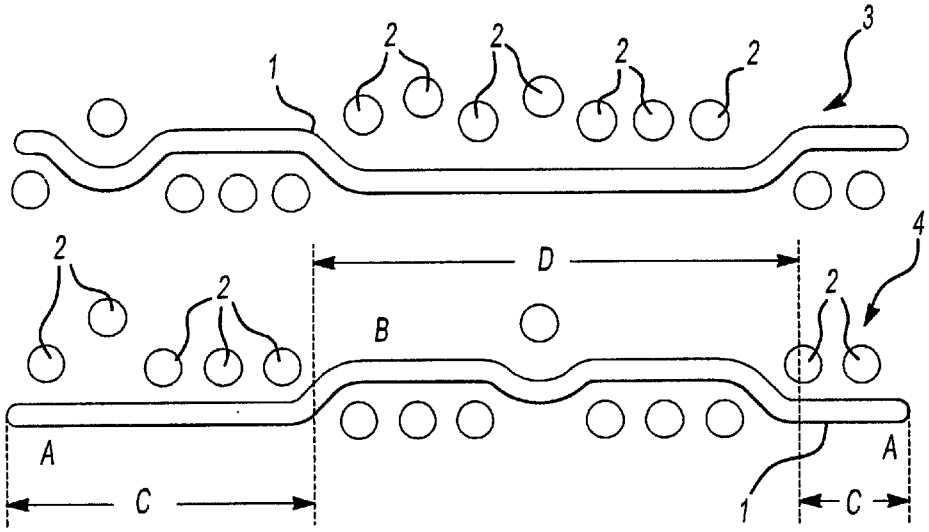

The invention relates to a multi-layer, especially double-layer or three-layer paper machine wire for dewatering and sheetforming purposes comprising a multi-layer paper machine wire for dewatering and sheet forming, comprising an upper and a lower weft threads layer or an upper fabric and a lower fabric arranged one over the other and connected to one another by binding threads being fabric born threads, and extending in a special manner from one fabric layer into the respective other one fabric layer.

Such kind of paper machine wires are for instance known from the European Patent Specification 432,413 (U.S. Pat. No. 5,152,326). They form composite fabrics and are used for the wet end of paper making machines in order to dewater the fiber suspension fed over the pulp entry onto the wire and in order to lead the developing paper web to the press section of the paper machine.

The properties and characteristics of the surface of the paper which is to be manufactured depend largely with respect to its printing quality, smoothness and number of wire marks on the quality of the wire web. It is already known that the requested high wearing resistance of those wire webs does not or not most favourably harmonize with the requested surface quality of the paper and that in this connection the stability of the fabric, for instance, is reduced considerably, if the fineness of a wire is increased. On the other hand the requested recuction of wire marks, i.e. the undesired impressions of the yarn of the paper forming fabric into the surface of the paper web should be avoided. Many proposals have been made to solve these problems in order to manufacture a most favourable paper quality. Thus, for instance it was proposed to connect the several layers of the fabric, for instance a so-called three-layer fabric, by binding warp threads or binding weft threads using as binder threads two fabric born threads which are interwoven in a special manner with the respective fabric layer.

It was find out, however, that the problem of reducing wire marking cannot completely be solved by such a measure. Particularly in those cases, in which the wearing threads have a binding function according to which the exchangeably working threads are either filament supporting and binding or supporting, binding and wear contributing or filament supporting and abrasion contributing, these threads are the reason for wire marks continually created on the running side of the fabric.

SUMMARY OF THE PRESENT INVENTION

Therefore, it is an object to be solved by the invention to reduce the creation of wire marks on paper machine wires by exchangeably working threads on the running side. According to a further object the wearing volume or capacity should be increased comparing it with that one of the known wires provided with exchangeably working or functioning threads.

These and other objects are solved according to the subject invention by the provision of a paper making wire, comprising a lower fabric manufactured of exchangeably functioning weft threads changing alternatively from the running side to the center position overlapping the warp threads within the region of exchange and protecting thereby the warp against wear and forming on extending between the fabric layers on the paper side an additional cushion against the creation of wire marks on the lower fabric.

The essential idea of the subject invention should be seen therein that the weft threads on the running side of two-layer or multi-layer paper machine wire are configured in form of threads working exchangeably between the center position and the running side of the fabric so that the lower fabric is protected in such an extent that its capability of forming wire marks with respect to dewatering pulses is essentially reduced so that the upper fabric is floating to some extent on the lower fabric, if two layer or three layer composite fabrics are used. Moreover, by the selected kind of binding the weft threads on the running side protect in case of double-layer fabrics on the running side the through-binding warp threads or in case of three-layer fabrics on the running side the lower warp threads against wearing.

Thus, under consideration of the above mentioned proposals an advantageous embodiment of the subject invention is characterized by leading in the region of exchange the throughbinding or binding, respectively, warp threads on the running side in the area of exchange below the alternatingly or exchangingly running weft threads.

According to a further advantageous embodiment of the invention the lower fabric comprises a satin binding or a twill binding or another binding derived from them.

DETAILED DESCRIPTION OF THE PRESENT INVENTION

Figure 2:
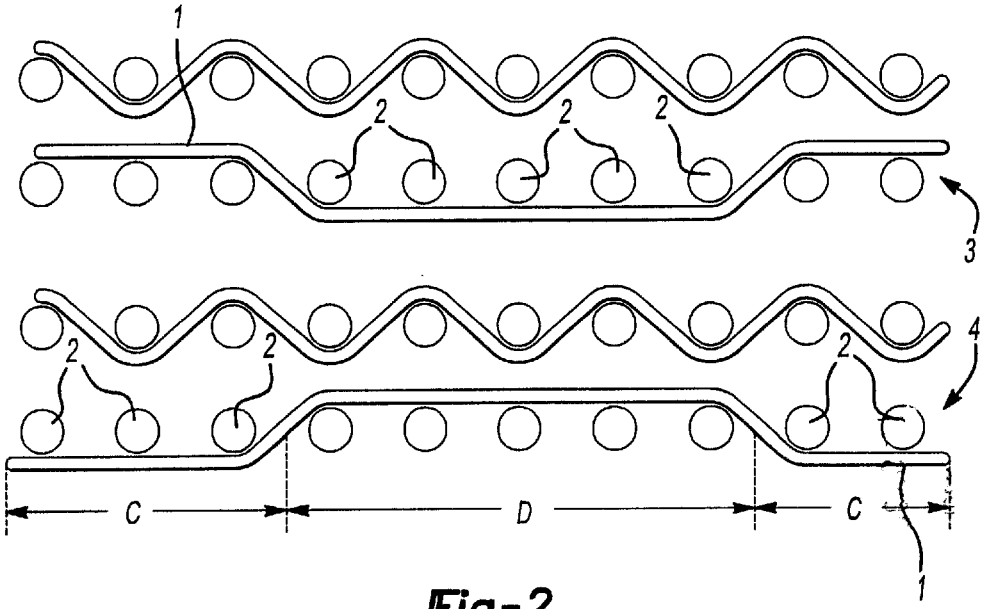

An embodiment of the invention will be described in detail in the following in connection with the drawings, in which FIG. 1 is a schematic cross-section view (warp section view) of a double-layer fabric according to the invention, and FIG. 2 is a schematic cross-section view (warp section view) of a three-layer fabric according to the invention.

Figure 3:
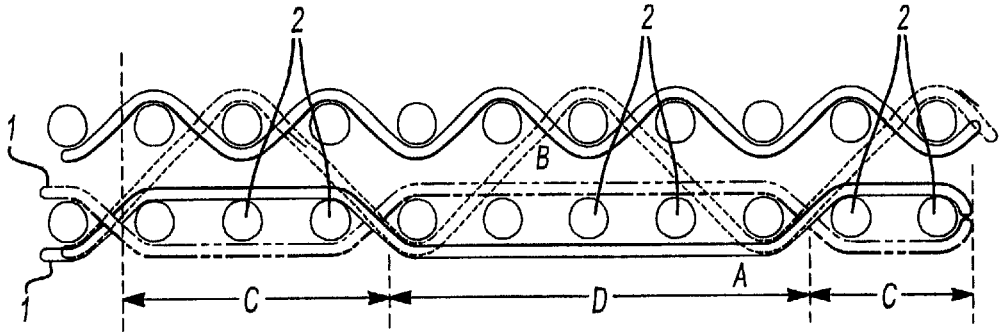

FIG. 3 is a schematic cross-section view of the double-layer fabric of FIG. 1 including a binding thread.

The double-layer fabric of FIG. 1 comprises succeding exchangeably working weft threads on the running side of the fabric or wire. This fabric comprises weft threads 1 and warp threads 2 bound into the upper fabric 3 and lower fabric 4 which are connected to one another by warp threads woven through.

The weft threads 1 of the lower fabric are functioning exchangeably, that means that they alternatively change from the running side A to the center position B and overlap within the region of exchange C the warp threads 2 in order to protect them against wearing which takes place, if these warp threads directly touch the paper machine, i.e. their dewatering and leading elements in the region of the sheet forming section. Between two regions C following one another there is an region D in which the weft threads 1 run exchangeably within the center position and thus between the fabric layers and over the warp threads 2 located in this phase of binding on the running side so that they form an additional cushion against wire marking of the paper web caused by the lower fabric.

Moreover, as can be gathered from FIG. 1, the binding through warp threads on the running side and thus the warp threads 2 within the region D of exchange are located such that they run below the exchangeable weft threads.

This lower fabric, the upper fabric of which seems in case of two-layer and three-layer wires to float on the lower fabric comprises preferably a satin binding or a twill binding or another kind of binding derived from them. Additionally, the warp threads binding-through are protected on the running side by the selected kind of binding in case of double-layer fabrics, as shown in FIG. 1, against wearing by the weft threads on the running side.

A three-layer fabric according to the invention as shown in FIG. 2 corresponds essentially to the features of the double-layer fabric described above in connection with FIG. 1, with the only exception that in case of three-layer fabrics the binding lower warp threads are dependent on the selected kind of binding on the running side protected against wearing by the weft threads on the running side.

To summarize the above one can say that in contrast to the already known exchangeably functioning bindings of multi-layer paper machine wires according to which the wearing threads have a binding-through function and thus no function avoiding the development of wire marks, the fabric according to the subject invention avoids wire marks and increases moreover essentially the wearing capacity on comparison with the mentioned known fabrics.

What is claimed is:

1. A multi-layer paper machine wire for dewatering and sheet forming, said wire comprising an upper fabric having a paper side and a lower fabric having a running side, said upper and lower fabric being arranged one over the other to form a center position therebetween and being connected to one another by binding threads extending from one fabric into the respective other fabric, characterized in that the lower fabric comprises weft threads alternately changing from said running side of the lower fabric to said center position, which weft threads overlap within a region of exchange, the weft threads of the lower fabric protecting the warp threads against wear and forming during operation on said paper side between the fabric an additional cushion against marking of the lower fabric.

2. The multi-layer paper machine wire according to claim 1, characterized in that the binding or binding through, respectively warp threads on the running side of the fabric extend below the exchangeably running weft threads.

3. The multi-layer paper machine wire according to claim 1, characterized in that the lower fabric is comprised of a satin binding or a twill binding.

4. The multi-layer paper machine wire according to claim 2, characterized in that the lower fabric is comprised of a satin binding or a twill binding.

5. A multi-layer paper machine wire for dewatering and sheet forming, said wire having an upper fabric having a paper forming side and a lower fabric having a running side, said upper and lower fabric forming a center position between said upper and lower fabric, said lower fabric comprising a first and a second weft thread, said first weft thread extending from said running side of the lower fabric to said center position and said second weft thread extending from said center position to said running side, such that at least a first portion of said weft thread runs under warp threads in said lower fabric to protect said warp threads against wear and at least a second portion of said first weft thread forms a cushion against marking.

6. The multi-layer paper machine wire of claim 5, wherein said lower fabric further comprises a satin binding.

7. The multi-layer paper machine wire of claim 5, wherein said lower fabric further comprises a twill binding.

8. The multi-layer paper machine wire of claim 5, wherein said wire comprises a double-layer fabric.

9. The multi-layer paper machine wire of claim 5, wherein said wire comprises a three-layer fabric.

10. A multi-layer paper machine wire having a paper side and a running side comprising:

an upper fabric;

a lower fabric, said lower fabric having a plurality of warp threads, a first weft thread and a second weft thread, said plurality of warp threads having a first side and a second side, said first weft thread having a first portion extending along said first side of said plurality of warp threads, said second weft thread having a first portion extending along said second side of said plurality of warp threads, said first and second weft threads crossing said plurality of warp threads such that a second portion of said first weft thread extends along said second side of said plurality of warp threads and a second portion of said second weft thread extends along said first side of said plurality of warp threads such that no warp thread of said plurality of warp threads is exposed to said running side of said wire.

11. The multi-layer paper machine wire of claim 10 further comprising a binding thread.

* * * * *

UNITED STATES PATENT AND TRADEMARK OFFICE

CERTIFICATE OF CORRECTION

PATENT NO. : 6,546,964 B1
DATED : April 15, 2003
INVENTOR(S) : Arved H. Westerkamp It is certified that error appears in the above-identified patent and that said Letters Patent is hereby corrected as shown below:

Column 2,
Line 12, replace “through-binding” with -- throughbinding --.

Signed and Sealed this

Twenty-third Day of December, 2003

JAMES E. ROGAN
*Director of the United States Patent and Trademark Office*